US006964625B2

(12) United States Patent
Murphy et al.

(10) Patent No.: US 6,964,625 B2
(45) **Date of Patent: *Nov. 15, 2005**

(54) GAME BALL LACING

(75) Inventors: Kevin J. Murphy, Chicago, IL (US); Douglas G. Guenther, Wheaton, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 236 days.

This patent is subject to a terminal disclaimer.

(21) Appl. No.: 10/274,704

(22) Filed: Oct. 19, 2002

(65) Prior Publication Data

US 2003/0045385 A1 Mar. 6, 2003

Related U.S. Application Data

(62) Division of application No. 09/946,037, filed on Sep. 4, 2001, now Pat. No. 6,629,902.

(51) Int. Cl.[7] ..... A63B 43/02; B32B 3/26; B32B 7/02; D02G 3/36; A43C 1/00

(52) U.S. Cl. ..... 473/597; 473/596; 428/158; 428/160; 428/220; 428/332; 57/210; 57/215; 57/216; 57/223; 24/712; D21/712

(58) Field of Search ..... 57/210–234; 24/712; 473/597, 596; 428/158, 160, 220, 304.4, 315.9, 332; D21/712

(56) References Cited

U.S. PATENT DOCUMENTS 5,029,372 A * 7/1991 Brinson ..... 24/715.4
5,557,864 A * 9/1996 Marks ..... 36/50.1
6,761,654 B2 * 7/2004 Murphy et al. ..... 473/596

* cited by examiner

*Primary Examiner*—Terrel Morris
*Assistant Examiner*—Lynda Salvatore
(74) *Attorney, Agent, or Firm*—Terence P. O'Brien

(57) ABSTRACT

A game ball including a casing and a lacing. The casing has a laced region. The lacing is coupled to the laced region of the casing. The lacing has an exposed surface comprised of an outer material that is compressible, resilient, and tactile. The outer material has a modulus of elasticity of between 14 and 170 kg/cm$^2$ and a tensile strength between 100 and 650 kg/cm$^2$. At least a portion of the lacing can have an exposed pebbled surface.

25 Claims, 9 Drawing Sheets

GAME BALL LACING

RELATED U.S. APPLICATION DATA

The present application is a division of U.S. patent Appl. Ser. No. 09/946,037, entitled Game Ball Lacing, filed on Sep. 4, 2001 by Murphy et al, now U.S. Pat. No. 6,629,902.

FIELD OF THE INVENTION

The present invention relates generally to a laced game ball. In particular, the present invention relates to an improved lacing for a laced game ball.

BACKGROUND OF THE INVENTION

Laced game balls, such as footballs, are well known and are included among the most popular game balls in the United States. Footballs typically include an inner inflatable air bladder and an outer casing having a longitudinally extending, elongate slot. The air bladder is inserted into the casing through the slot and secured within the outer casing by a lacing. The lacing resembles a shoelace and typically is made of one or more leather strips, braided fibers, or braided fibers having an outer latex coating. When assembled, the lacing generally outwardly extends from the casing forming a number of raised ridges that facilitate grasping and passing of the football. The lacing further facilitates a player's ability to impart a spin onto the football during passing thereby producing a spiral trajectory of the ball. The spiral trajectory generally improves the distance of a thrown football.

In football, as in many other sports, the gripping and tactile characteristics of the ball can considerably affect the performance of the participating players. In particular, the lacing of a football significantly contributes to the football's gripping and tactile characteristics, and, not surprisingly, to the player's ability to pass the ball accurately and for distance. The lacing also typically plays a role in the player's ability to catch or to hold on to the football. Further, because football games are typically played outdoors, in unpredictable and inclement weather conditions including rain, sleet and snow, the player's ability to adequately grip the ball is particularly dependent upon the gripping and tactile characteristics of the ball and the lacing.

Lacings on earlier football designs typically included leather strips or braided fibers, such as cotton fibers. These lacing materials sufficiently enclosed the slot and retained the bladder within the outer casing, but they generally did not wear well, could become slippery when wet, and portions of the lacings could be shifted or dislodged during use. Existing lacings in more recent football designs are typically formed of braided fibers or extruded strands and include an outer layer of latex or plastic. Such existing lacings wear, and retain their position, well, but can be quite hard, and are relatively smooth and slippery, particularly in wet play conditions. Even when such lacings have a roughened exterior surface, they often remain quite slippery and difficult to grasp, particularly in wet conditions. Hard, relatively smooth or slippery lacings can contribute to poorly thrown passes, incompletions and fumbles. Others have attempted to solve these problems by significantly changing the shape of the football or by applying multiple sets of lacings to a football. These types of proposed solutions are radical departures from the design and look of a traditional American football. Not surprisingly, these types of radical design changes are not widely accepted, particularly in organized play.

Thus, there is a need for a lacing for a sports ball, such as a football, that improves the gripping and tactile characteristics of the sports ball without radically departing from the ball's traditional design. What is needed is a lacing that improves a player's ability to pass, catch or grip a ball. Further, it would be advantageous to provide a football and lacing that can be more readily thrown in a spiral trajectory. What is also needed is a football that can contribute to reducing the number of fumbles, incompletions and poorly thrown balls during the course of a game or a season, particularly during inclement weather.

SUMMARY OF THE INVENTION

The present invention provides a game ball including a casing and a lacing. The casing has a laced region. The lacing is coupled to the laced region of the casing. The lacing has an exposed surface comprised of an outer material that is compressible, resilient, and tactile. The outer material has a modulus of elasticity of between 14 and 170 kg/cm$^2$ and a tensile strength between 100 and 650 kg/cm$^2$.

According to a principal aspect of a preferred form of the invention, a game ball includes a casing and a lacing. The casing has a laced region. The lacing is coupled to the laced region of the casing. The lacing has an exposed surface. At least a portion of the exposed surface of the lacing has a pebbled texture.

According to another preferred aspect of the invention provides a game ball includes a casing and a lacing. The casing has a laced region. The lacing is coupled to, and generally surrounds the laced region of the casing. The lacing includes an inner substrate attached to an outer layer. The outer layer of the lacing has an exposed surface made of an outer material that is compressible, resilient, and tactile.

According to another preferred aspect of the invention provides a lacing for a sporting goods product. The lacing includes an inner substrate and an outer layer. The inner substrate is made of a high tensile strength material. The outer layer is coupled to the inner substrate. The outer layer is made of a material that is soft, compressible, resilient, and tactile. The material of the outer layer has a modulus of elasticity of between 14 and 170 kg/cm$^2$ and a tensile strength between 100 and 650 kg/cm$^2$.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
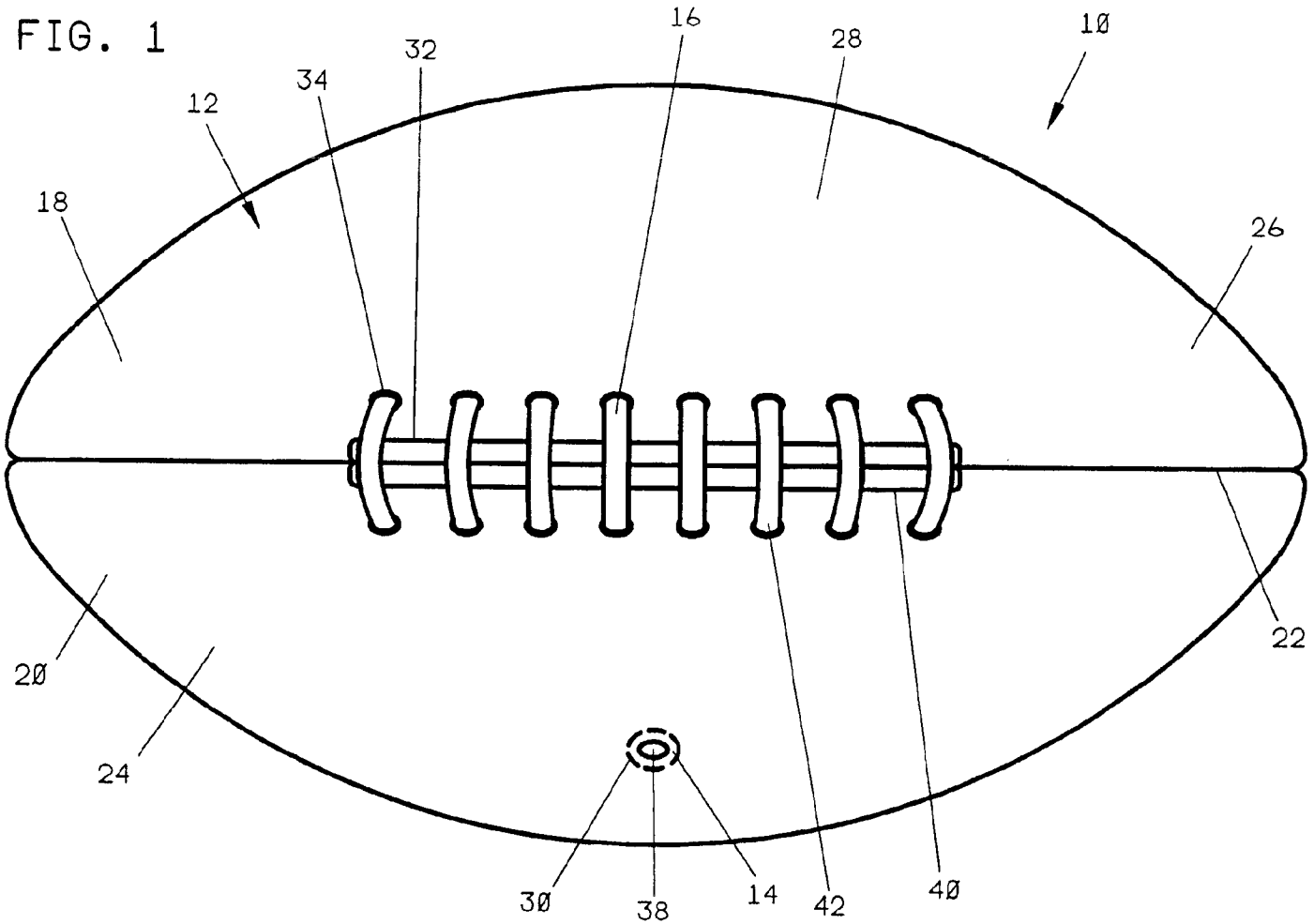
FIG. 1 is a top plan view of an American football in accordance with a preferred embodiment of the present invention.
Figure 2:
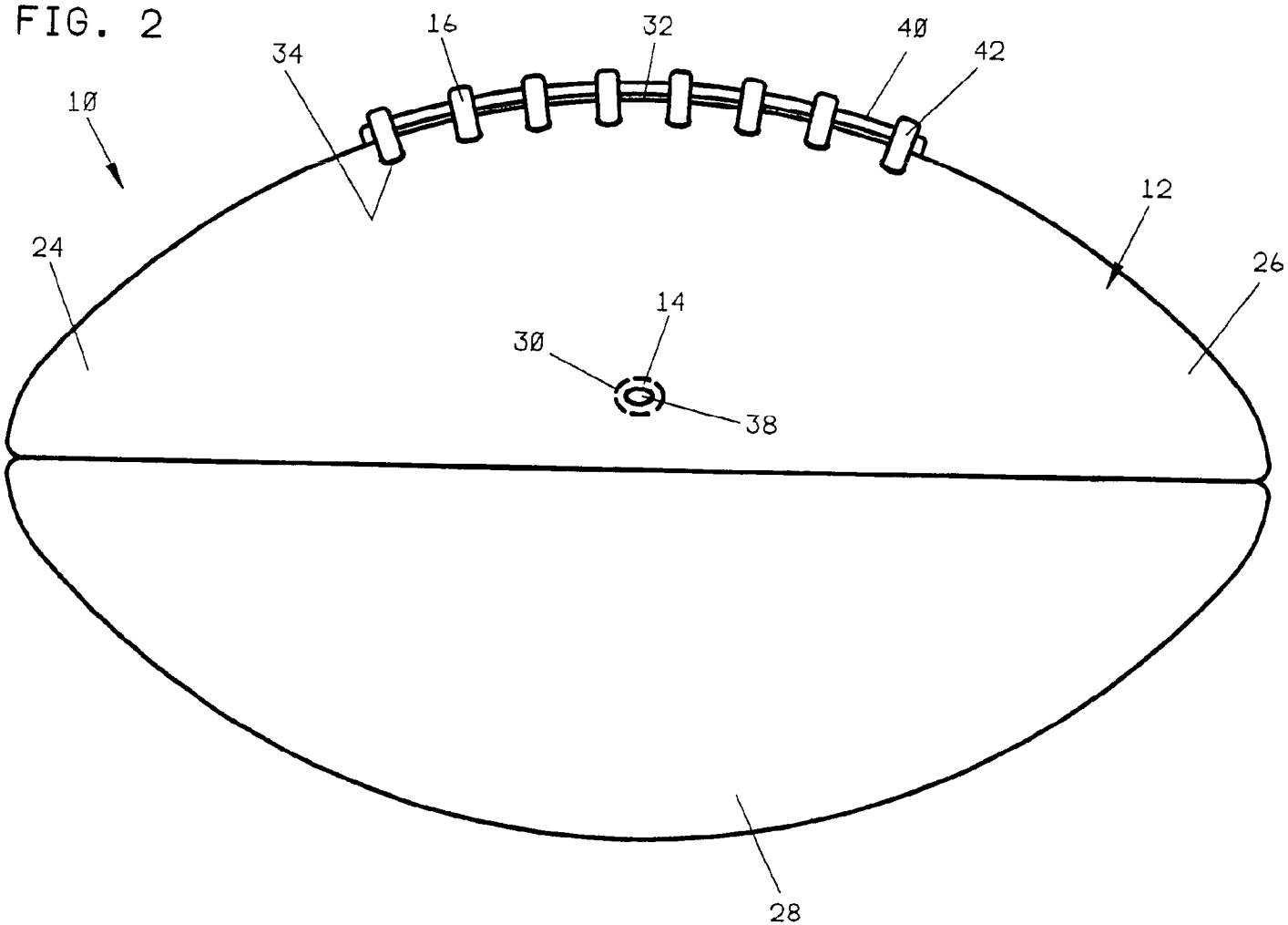
FIG. 2 is a side elevational view of the football of FIG. 1.

Referring to FIGS. 1 and 2, an American football is indicated generally at 10. The football 10 is one example of a laced sports ball. The present application is directly applicable to all laced sports balls and other sporting goods products including, for example, footballs, rugby balls, soccer balls, basketballs, baseball mitts and volleyballs.

The football 10 is a generally prolate spheroidal shaped inflatable object having a major longitudinal dimension and a minor transverse dimension. The football 10 includes a casing 12, a bladder 14 and a lacing 16. The casing 12 is a prolate spheroidal shaped outer body preferably formed from four quarter sections (first and second quarter sections 18 and 20 are shown in FIG. 1) that are joined to one another along longitudinal seams (a first longitudinal seam 22 is also shown in FIG. 1). The casing 12, when assembled, has first and second end portions 24 and 26 separated by a central portion 28. The central portion 28 of the casing 12 includes a valve aperture 30 and a longitudinally extending slot 32 positioned in line with the first longitudinal seam 22 and between two parallel longitudinally extending rows of spaced apart lace holes 34. The casing 12 is typically made of leather, rubber or a synthetic polymeric plastic material. An outer surface of the casing 12 preferably includes a pebbled texture for enhancing the grip and improving the aesthetics of the football 10.

The bladder 14 is an inflatable air tube preferably having a prolate spheroidal shape. The bladder 14 is inserted into the casing 12 through the slot 32. The bladder 14 enables the football 10 to retain a predetermined amount of air thereby achieving the desired firmness to the football 10. The bladder 14 is typically made of latex, butyl rubber or other suitable material. The bladder 14 includes a valve 38 that extends through the valve aperture 30 of the casing 12 for access by a user. In an alternative embodiment, the casing 12 and the bladder 14 can be integrally formed together. In another alternative embodiment, the football can be formed without a bladder.

The lacing 16 is preferably a single elongate cord. Alternatively, the lacing 16 can include a plurality of cords. The lacing 16 is threaded through the lace holes 34 of the casing 12. The lacing 16 enables the two parallel longitudinally extending rows of spaced apart lace holes 34 to be drawn together thereby closing the slot 32 retaining the bladder 14 within the casing 12. When installed onto the football 10, the lacing 16 preferably includes two substantially exposed longitudinally extending segments 40 and eight substantially exposed transversely extending segments 42. In alternative preferred embodiments, other numbers of substantially exposed longitudinal and transverse segments 40 and 42 can be used. The longitudinal and transverse segments 40 and 42 of the lacing outwardly extend from the casing 12 to provide raised surfaces for a player to contact when passing, catching or holding onto the football 10. Players when passing the football 10 will typically place one or more of their fingertips onto the raised surfaces of the lacing 16 in order to throw a more accurate pass and to impart a spiral trajectory onto the thrown ball. In one preferred embodiment, an installed lacing 16 has a length of approximately 4.5 inches.

Figure 3:
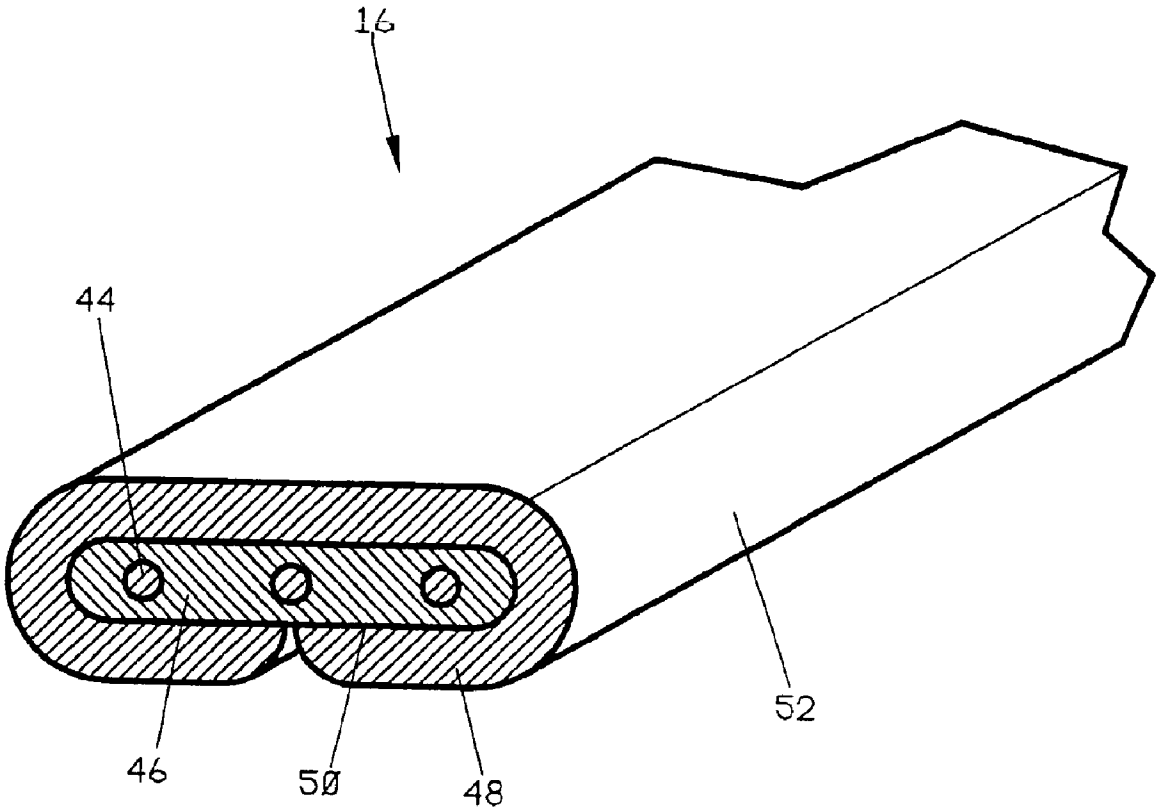
FIG. 3 is a sectional, front perspective view of a lacing of the football of FIG. 1.

FIG. 3 illustrates a preferred embodiment of the lacing 16. The lacing 16 includes at least one elongate strand 44, an inner layer 46, and an outer layer 48. The strand 44 is formed of a high tensile strength material, preferably nylon. In alternative preferred embodiments, the strand or strands 44 can be formed of polyester, metal, braided fibers, a high tensile strength polymer or combinations thereof. In a particularly preferred embodiment, three strands 14 are included in a spaced apart configuration within the lacing 16. The strand 44 increases the tensile strength of the lacing 16 enabling the lacing 16 to withstand significant stresses during use without failing.

The inner layer 46 surrounds the strands 44 within the lacing 16. The inner layer 46 is formed of a pliable material, preferably vinyl or plastic. Alternatively, other materials can be used, such as, for example, a cloth, leather or other polymers. The inner layer 46 is preferably formed with a generally uniform cross-sectional area resembling a flattened oval. Alternatively, the inner layer 46 can have a circular cross-section or other shapes. The strands 44 and the inner layer 46 are preferably produced as a co-extrusion. Alternatively, the strands 44 alone can be extruded and the inner layer 46 can be attached to, and substantially surround, the strands 44.

The outer layer 48 is a sheet of material that is preferably soft, compressible, resilient, tactile, porous and spongy. The outer layer 48 has an inner surface 50 and an outer surface 52. The inner surface 50 of the outer layer 48 is attached to, and preferably substantially surrounds, the inner layer 46. The outer layer 48 is preferably affixed to the inner layer 46. In other alternative embodiments, the outer layer 48 can be attached to the inner layer 46 through stitching, stapling, mechanical bonding, heat bonding or other conventional fastening means. The outer layer 48 provides the lacing 16, and in particular the exposed portions of the lacing 16, with a soft, tactile and resilient feel that enhances the player's ability to easily grip, throw, or retain the football 10 when contacting the lacing 16. The outer layer 48 of the lacing 16 is preferably made of a wet process polyurethane material. Alternatively, the outer layer 48 can be formed of other materials, such as, for example, dry process polyurethane, a polyvinylchloride foam, other polymers, other foams or combinations thereof. The material of the outer layer preferably has a modulus of elasticity of between 14 and 170 kg/ $cm^2$ and a tensile strength of between 100 and 650 kg/ $cm^2$. In a particularly preferred embodiment, the material of the outer layer has a modulus of elasticity of between 30 and 110 kg/ $cm^2$ and a tensile strength between 450 and 600 kg/ $cm^2$. The outer surface 52 of the outer layer 48 includes a roughened texture. Further, the outer layer 48 of the lacing 16 preferably has a white or a brown color. Alternative colors or combination of colors are also contemplated.

Unlike existing lacings that typically include a relatively hard, and often slippery, outer surface, the soft tactile outer layer 48 significantly improves the grip-ability of the lacing 16 thereby facilitating the player's ability to firmly grasp, throw or catch the football 10. The outer layer 48 of the lacing 16 provides an increased frictional interaction between the lacing 16 and the fingertips of the player. The soft tactile outer layer 48 also enhances the player's ability to impart a spin onto the football 10. The tactile, compressible and resilient outer layer 48 of the improved lacing 16 can also assist in reducing turnovers and incompletions and is well suited for inclement weather. Moreover, the lacing 16 provides the strength and durability of a traditional lacing with a soft, tactile outer surface that improves the overall feel, grip-ability and performance of the lacing 16. The lacing 16 is strong enough to withstand the stresses encountered during normal use without significantly wearing, fraying or elongating, while improving the overall feel of the lacing 16 to the user.

Figure 4:
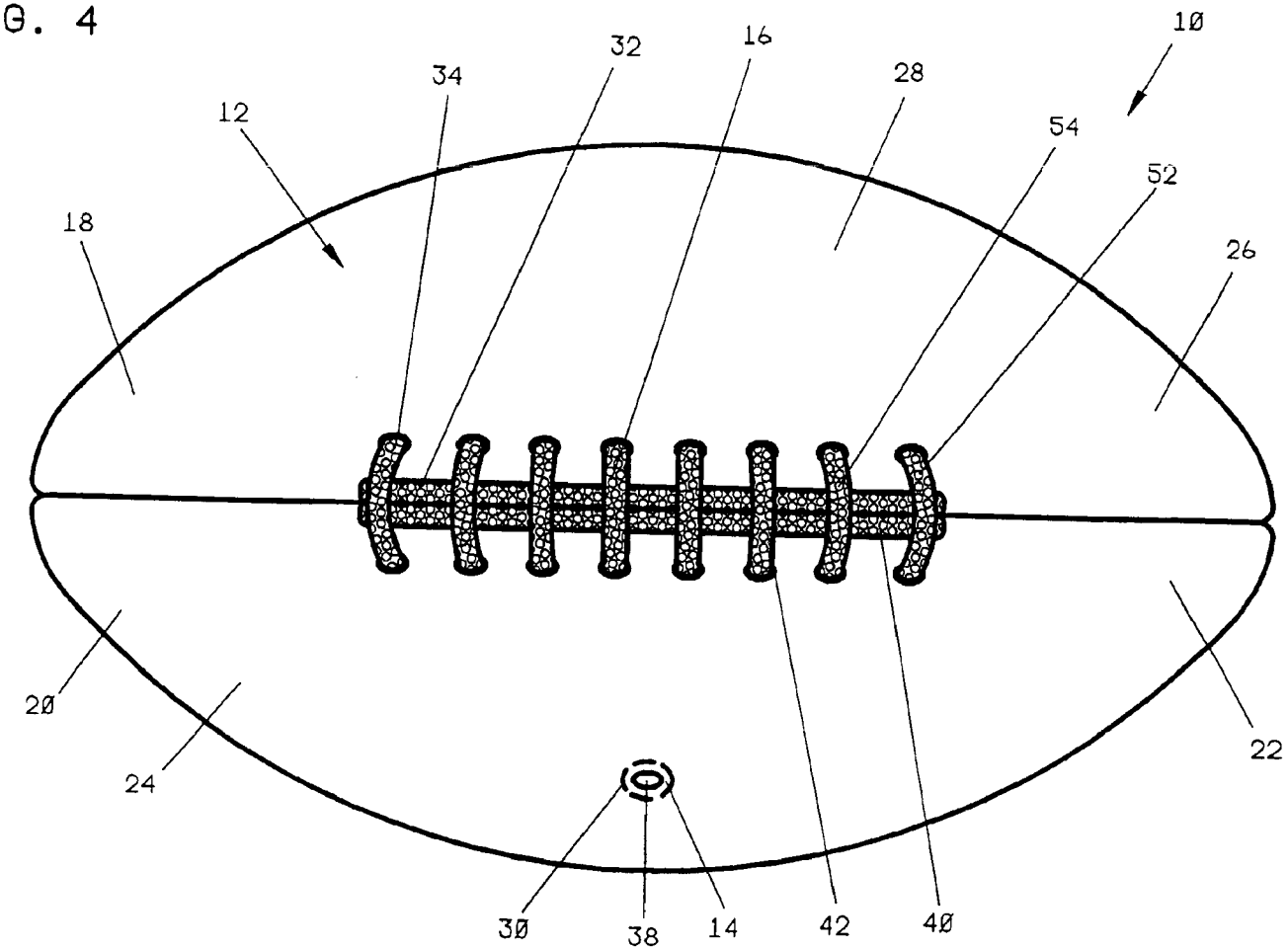
FIG. 4 is a top plan view of an American football according to an alternative preferred embodiment of the present invention.
Figure 5:
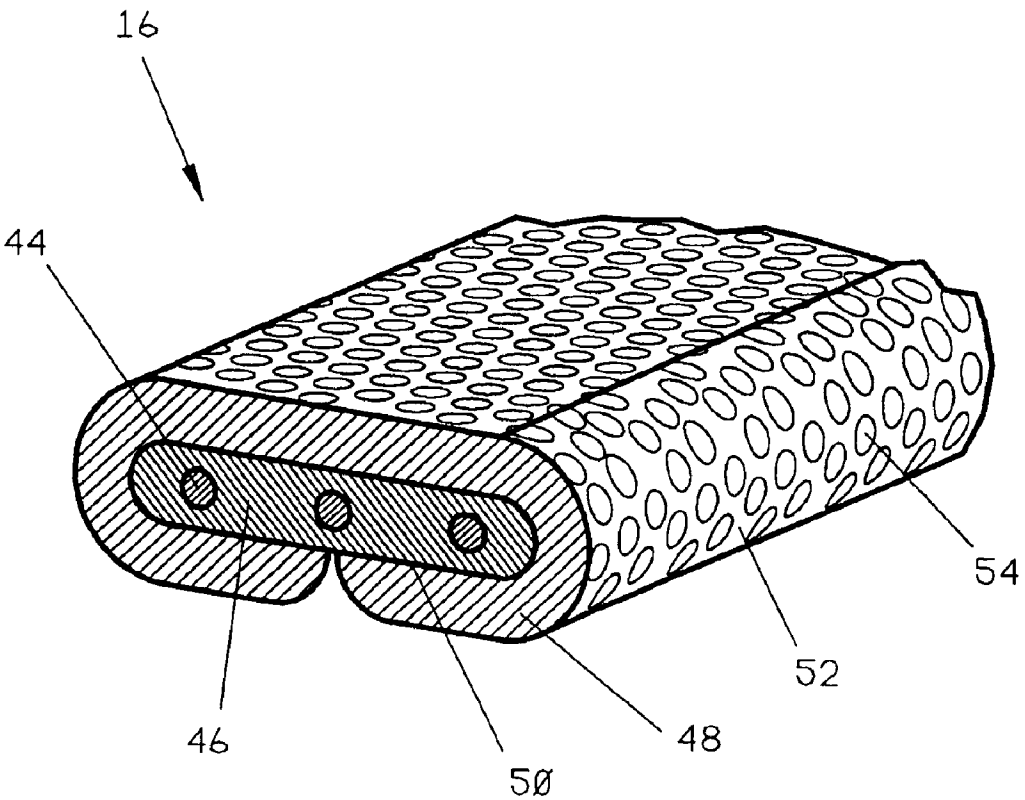
FIG. 5 is a sectional, front perspective view of a lacing of the football of FIG. 4.

FIGS. 4 and 5 illustrate another preferred embodiment of the present invention in which the roughened texture or grain of the outer surface 52 of the lacing 16 includes a plurality of pebble-like projections 54. The lacing 16 of FIGS. 4 and 5 is substantially similar to the lacing 16 of FIGS. 1 through 3. The pebble-like projections 54 provide the outer surface 52 of the lacing 16 with a pebbled texture that is substantially similar to the grip enhancing pebbled outer surface present on the casing of conventional footballs. The pebble-like projections 54 are preferably convex, rounded and spaced apart from one another. The pebble-like projections 54 further improve the player's ability to grip the football 10 and they also provide the lacing 16 with a unique appealing aesthetic. In an alternative preferred embodiment, the outer surface 52 of the lacing 16 can include a plurality of concave pebble-like projections. In other embodiments, the outer surface 52 can be cross-hatched, grainy, grooved or otherwise irregular to roughen the texture of the lacing 16.

The pebble-like projections 54 are preferably embossed, using a suitable stamping or rolling device under pressure and/or temperature, onto the outer surface 52 of the outer layer 48. Alternatively, the pebble-like projections 54 can be applied to the outer surface 52 via injection or compression molding. In another alternative preferred embodiment, the pebbled texture can be applied to the outer surface of virtually any type of lacing, such as, for example, a urethane or latex impregnated cloth lacing, a braided fiber lacing, a plastic lacing, a rubber lacing, and a leather lacing. In another alternative preferred embodiment, the pebble-like projections 54 are included on one of either the transverse segments 42 and the longitudinal segments 40. In another alternative preferred embodiment, the pebble-like projections are formed onto a portion of the outer surface 52 of the lacing 16.

Figure 6:
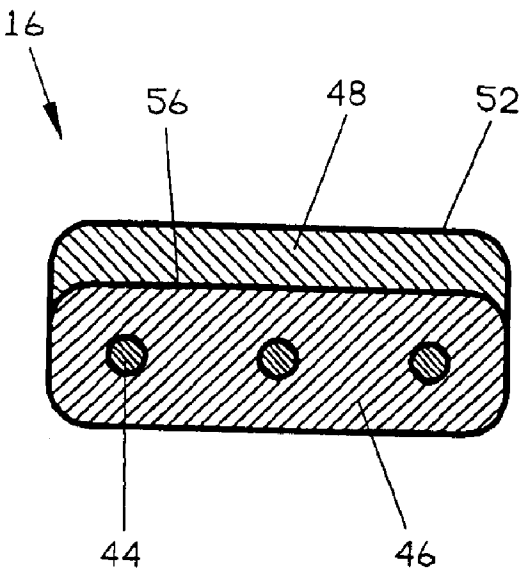
FIG. 6 is a cross-sectional view of a lacing in accordance with another alternative preferred embodiment of the present invention.

Referring to FIG. 6, in an alternative preferred embodiment of the present invention, the outer layer 48 is attached to, and substantially covers, an-outer (otherwise exposed) side 56 of the inner layer 46 of the lacing 16. In this embodiment, the soft, compressible, resilient and tactile outer layer 48 can be positioned on the outer side 56 of the lacing 16 while the remaining surfaces of the inner layer 46 of the lacing 16 are substantially uncovered by the outer layer 48. Placement of the outer layer 48 onto the outer side 56 of the inner layer 46 reduces the amount of material used to form the lacing 16. Moreover, placement of the outer layer 48 onto only the outer side 56 of the inner layer 46 reduces the overall thickness and weight of the lacing 16. In a particularly preferred embodiment, the outer surface 52 of the outer layer 48 includes a pebbled texture.

Figure 7:
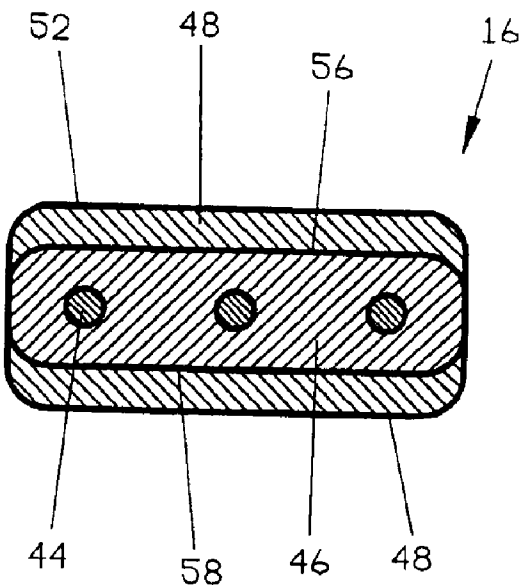
FIG. 7 is a cross-sectional view of a lacing in accordance with another alternative preferred embodiment of the present invention.

Referring to FIG. 7, another alternative preferred embodiment of the present invention is illustrated. The outer layer 48 is placed onto an outer surface 56 of the inner layer 46 and onto an inner surface 58 of the inner layer 46 leaving the remaining surfaces of the lacing substantially uncovered. In this preferred embodiment, the thickness of the lacing 16 is substantially unchanged from the preferred embodiment of the lacing 16 of FIGS. 1 through 3. In a particularly preferred embodiment, the outer surface 42 of the outer layer 48 includes a pebbled texture.

Figure 8:
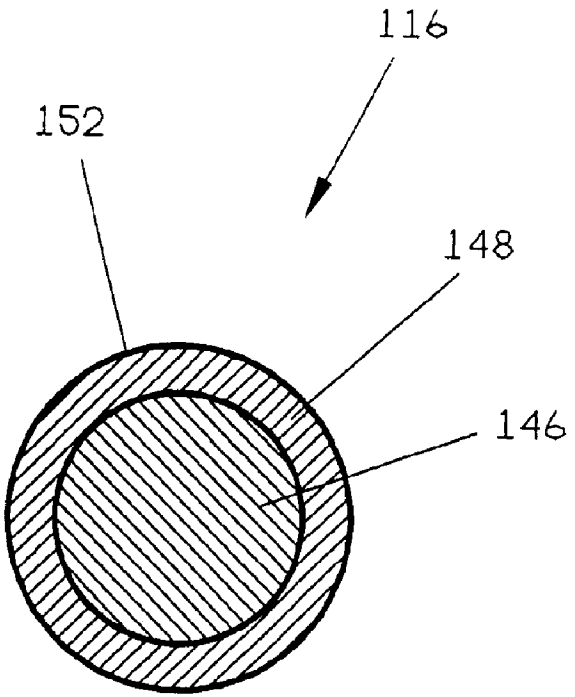
FIG. 8 is a cross-sectional view of a lacing in accordance with another alternative preferred embodiment of the present invention.

Referring to FIG. 8, another alternative embodiment of the present invention is illustrated. A lacing 116 includes a substrate 146 and an outer layer 148. The outer layer 148 is substantially similar to the outer layer 48. The substrate 146 is a conventional lacing formed from a known lacing material, such as, for example, woven cloth, unwoven cloth, urethane or latex impregnated carrier cloth, nylon, plastic, braided fibers, rope, metal wire, leather, or a combination thereof. The lacing 116 has a circular cross-sectional shape. Other cross-sectional shapes are also contemplated. In a particularly preferred embodiment, the outer layer 148 includes a pebbled outer surface.

Figure 10:
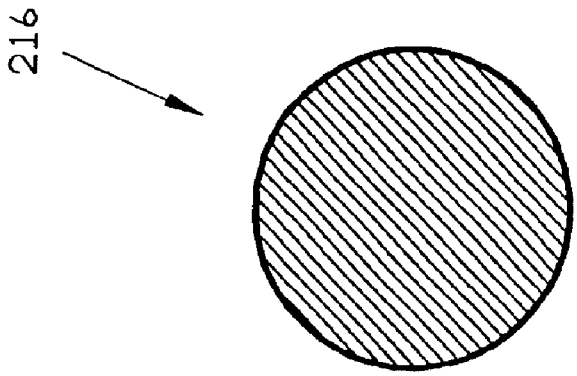
FIG. 10 is a cross-sectional view of a lacing in accordance with another alternative preferred embodiment of the present invention.
Figure 9:
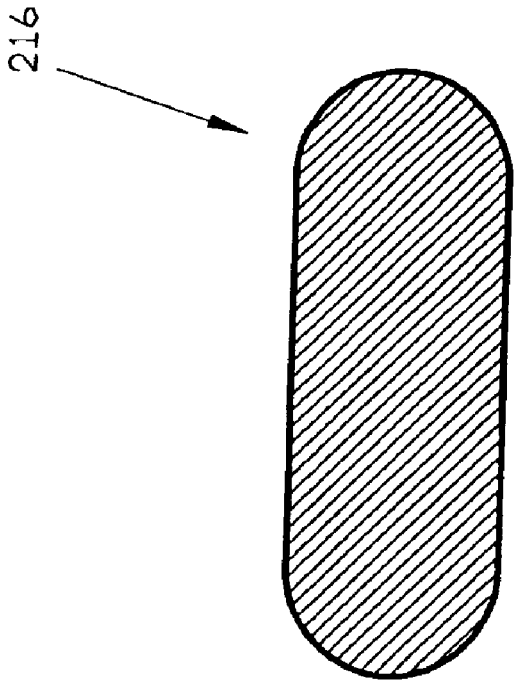
FIG. 9 is a cross-sectional view of a lacing in accordance with another alternative preferred embodiment of the present invention.

Referring to FIGS. 9 and 10, additional preferred embodiments of the present invention are illustrated. The lacing 216 is formed of a single continuous material that is soft, compressible, resilient and tactile. The material of the lacing 216 is substantially similar to the material of the outer layer 48. The lacing 216 can be formed in a circular or oval cross-sectional area. Other cross-sectional shapes are also contemplated. In a particularly preferred embodiment, an outer surface 252 of the lacing 216 is pebbled.

Figure 11:
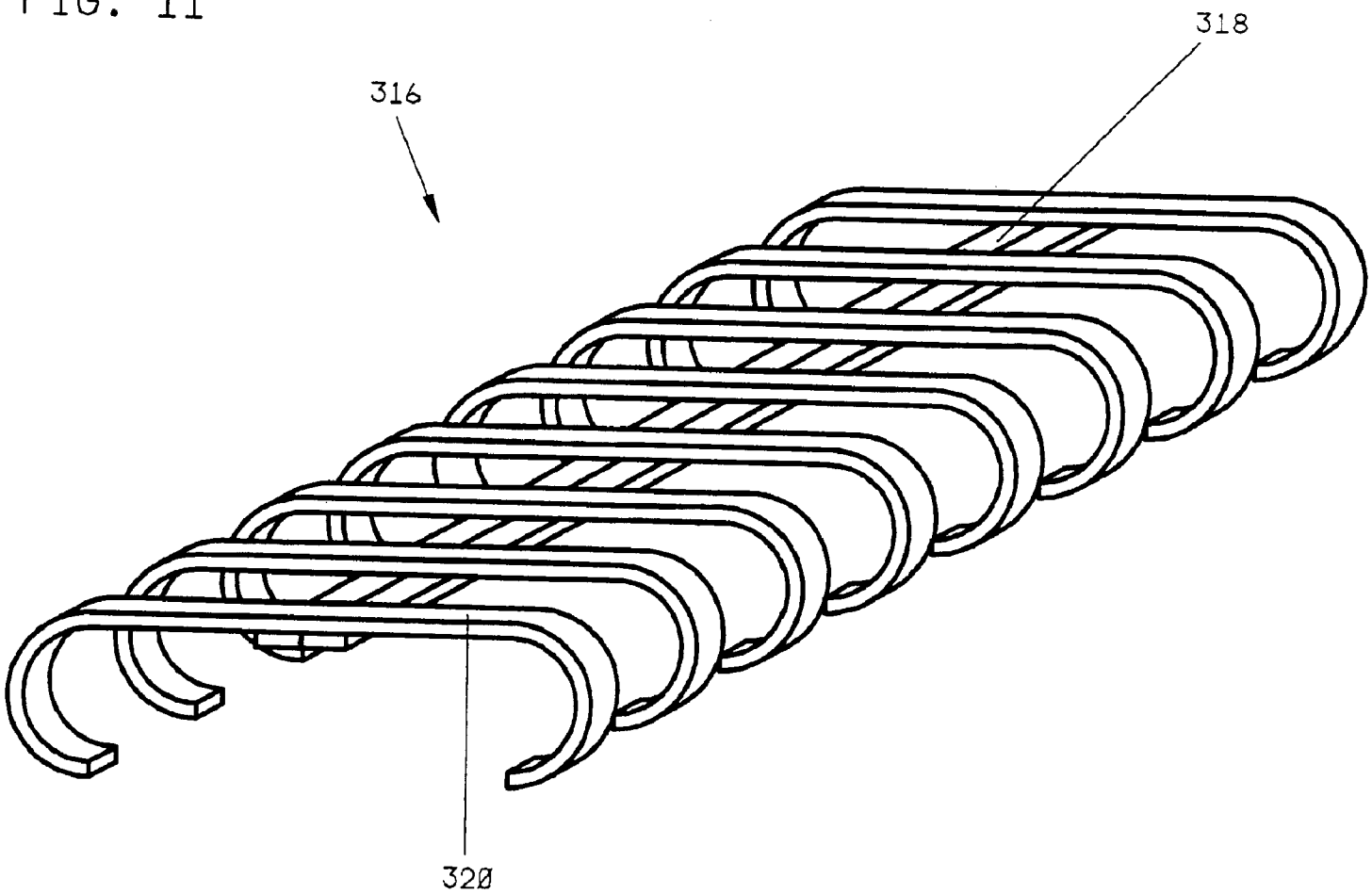
FIG. 11 is a front perspective view of a lacing in accordance with another alternative preferred embodiment of the present invention.

Referring to FIG. 11, another preferred embodiment of the present invention is illustrated. A lacing 316 is shown in a shape resembling an assembled lacing. The lacing 316 preferably includes two longitudinal lace segments 318 and eight transverse lace segments 320. In other preferred embodiments, other numbers and combinations of longitudinal and transverse lace segments 318 and 320 can be used. Each lace segment 320 can be formed to outwardly extend from the longitudinal lace segments 318 curve downward and then back toward the longitudinal lace segments. The lacing 316 can be molded as a single piece resembling an assembled lace. Alternatively, the longitudinal and transverse segments 318 and 320 can be formed separately and subsequently connected to each other to form the lacing 316. The lace segments 320 are configured to attach to the football 10 at the lace holes 34 (see FIG. 1). The lacing 316 is substantially similar to the lacing 16 of FIGS. 1 through 3. In a particularly preferred embodiment, the lacing 316 includes an outer layer 348 with a pebbled outer surface 352.

While the preferred embodiments of the present invention have been described and illustrated, numerous departures therefrom can be contemplated by persons skilled in the art, for example, the lacing can be a generally longitudinally ridge outwardly extending from the casing of the football. An outer layer of the ridge can be formed of a soft, compressible, tactile and resilient material, and an outer surface of the ridge can include a pebbled texture. Therefore, the present invention is not limited to the foregoing description but only by the scope and spirit of the appended claims.

What is claimed is:

1. A lacing for a sporting goods product, the lacing comprising:

an inner substrate of high tensile strength material; and an outer layer coupled to the inner substrate, the outer layer being made of a polymeric material that is soft, compressible, resilient, and tactile, the material of the outer layer having a tensile strength between 100 and 650 kg/cm$^2$, the outer layer having an exposed surface, and at least a portion of the exposed surface being pebbled.

2. A lacing for a sporting goods product, the lacing comprising:

an inner substrate of high tensile strength material; and an outer layer coupled to the inner substrate, the outer layer being made of a polymeric material that is soft, compressible, resilient, and tactile, the material of the outer layer having a tensile strength between 100 and 650 kg/cm$^2$, the material of the outer layer being selected from the group consisting of a wet process polyurethane, a dry process polyurethane, a polyvinylchloride foam, and a combination thereof.

3. A lacing for a sporting goods product, the lacing comprising:

an inner substrate of high tensile strength material; and an outer layer coupled to the inner substrate, the outer layer being made of a polymeric material that is soft, compressible, resilient, and tactile, the material of the outer layer having a tensile strength between 100 and 650 kg/cm$^2$, the inner substrate having a top side and a bottom side, and the outer layer being attached only to the top side.

4. A lacing for a sporting goods product, the lacing comprising:

an inner substrate of high tensile strength material; and an outer layer coupled to the inner substrate, the outer layer being made of a polymeric material that is soft, compressible, resilient, and tactile, the material of the outer layer having a tensile strength between 100 and 650 kg/cm$^2$, the inner substrate having a top side and a bottom side, and the outer layer being attached only to the top side and the bottom side.

5. A lacing for a game ball wherein the lacing includes an inner substrate attached to an outer layer, the outer layer of the lacing having an exposed surface made of an outer polymeric material that is compressible, resilient, and tactile, the lacing further including at least one longitudinally extending segment and a plurality of transversely extending segments.

6. A lacing for a game ball wherein the lacing includes an inner substrate attached to an outer layer, the outer layer of the lacing having an exposed surface made of an outer polymeric material that is compressible, resilient, and tactile, and wherein at least a portion of the exposed surface includes a pebbled texture.

7. A lacing for a game ball wherein the lacing includes an inner substrate attached to an outer layer, the outer layer of the lacing having an exposed surface made of an outer material that is compressible, resilient, and tactile, and wherein the outer layer is made of an outer material selected from the group consisting of a wet process polyurethane, a dry process polyurethane, a polyvinylchloride foam, and a combination thereof.

8. The lacing of claim 7, wherein the outer layer is coupled to the inner substrate using a means selected from the group consisting of adhesive bonding, stitching, stapling, mecahnical bonding, heat bonding and combinations thereof.

9. The lacing of claim 7, wherein the inner substrate is formed from at least one material selected from the group consisting of a woven cloth, a non-woven cloth, a urethane impregnated cloth, at least one nylon strand, at least one polyester strand, a plastic, a metal wire, a polymer, a latex, a rope, a leather strip and a combination thereof.

10. The lacing of claim 7 wherein the lacing includes at least one longitudinally extending segment and a plurality of transversely extending segments.

11. The lacing of claim 7, wherein the inner substrate has a top side and a bottom side, and wherein the outer layer is attached only to the top side.

12. The lacing of claim 7, wherein the inner substrate has a top side and a bottom side, and wherein the outer layer is attached only to the top side and the bottom side.

13. The lacing of claim 7, wherein the outer layer substantially surrounds the inner substrate.

14. The lacing of claim 2, wherein the outer layer is coupled to the inner substrate using a means selected from the group consisting of adhesive bonding, stitching, stapling, mechanical bonding, heat bonding and combinations thereof.

15. The lacing of claim 2, wherein the inner substrate is formed from at least one material selected from the group consisting of a woven cloth, a non-woven cloth, a urethane impregnated cloth, at least one nylon strand, at least one polyester strand, a plastic, a metal wire, a polymer, a latex, a rope, a leather strip and a combination thereof.

16. The lacing of claim 2, wherein the lacing includes at least one longitudinally extending segment and a plurality of transversely extending segments.

17. The lacing of claim 2, wherein the inner substrate has a top side and a bottom side, and wherein the outer layer is attached only to the top side.

18. The lacing of claim 2, wherein the inner substrate has a top side and a bottom side, and wherein the outer layer is attached only to the top side and the bottom side.

19. The lacing of claim 2, wherein the outer layer substantially surrounds the inner substrate.

20. The lacing of claim 5, wherein the outer layer is coupled to the inner substrate using a means selected from the group consisting of adhesive bonding, stitching, stapling, mechanical bonding, heat bonding and combinations thereof.

21. The lacing of claim 5, wherein the inner substrate is formed from at least one material selected from the group consisting of a woven cloth, a non-woven cloth, a urethane impregnated cloth, at least one nylon strand, at least one polyester strand, a plastic, a metal wire, a polymer, a latex, a rope, a leather strip and a combination thereof.

22. The lacing of claim 5, wherein the inner substrate has a top side and a bottom side, and wherein the outer layer is attached only to the top side.

23. The lacing of claim 5, wherein the inner substrate has a top side and a bottom side, and wherein the outer layer is attached only to the top side.

24. The lacing of claim 5, wherein the inner substrate has a top side and a bottom side, and wherein the outer layer is attached only to the top side and the bottom side.

25. The lacing of claim 5, wherein the outer layer substantially surrounds the inner substrate.

* * * * *

US006964625C1

(12) EX PARTE REEXAMINATION CERTIFICATE (5950th)

United States Patent

Murphy et al.

(10) Number: US 6,964,625 C1

(45) Certificate Issued: *Oct. 16, 2007

(54) GAME BALL LACING

(75) Inventors: Kevin J. Murphy, Chicago, IL (US); Douglas G. Guenther, Wheaton, IL (US)

(73) Assignee: Wilson Sporting Goods & Co., Chicago, IL (US)

Reexamination Request:
No. 90/008,247, Sep. 26, 2006

Reexamination Certificate for:

| | |
|---|---|
| Patent No.: | **6,964,625** |
| Issued: | **Nov. 15, 2005** |
| Appl. No.: | **10/274,704** |
| Filed: | **Oct. 19, 2002** |

( * ) Notice: This patent is subject to a terminal disclaimer.

Related U.S. Application Data

(62) Division of application No. 09/946,037, filed on Sep. 4, 2001, now Pat. No. 6,629,902.

(51) Int. Cl.

| | |
|---|---|
| ***A63B 43/02*** | (2006.01) |
| ***B32B 3/26*** | (2006.01) |
| ***B32B 7/02*** | (2006.01) |
| ***D02G 3/36*** | (2006.01) |
| ***A43C 1/00*** | (2006.01) |

(52) U.S. Cl. ..... 473/597; 473/596; 428/158; 428/160; 428/220; 428/332; 57/215; 57/216; 57/223; 57/210; 24/712; D21/712

(58) Field of Classification Search ..... None
See application file for complete search history.

(56) References Cited

U.S. PATENT DOCUMENTS 5,570,882 A 11/1996 Horkan

*Primary Examiner*—Jeffrey R. Jastrzab

(57) ABSTRACT

A game ball including a casing and a lacing. The casing has a laced region. The lacing is coupled to the laced region of the casing. The lacing has an exposed surface comprised of an outer material that is compressible, resilient, and tactile. The outer material has a modulus of elasticity of between 14 and 170 kg/cm$^2$ and a tensile strength between 100 and 650 kg/cm$^2$. At least a portion of the lacing can have an exposed pebbled surface.

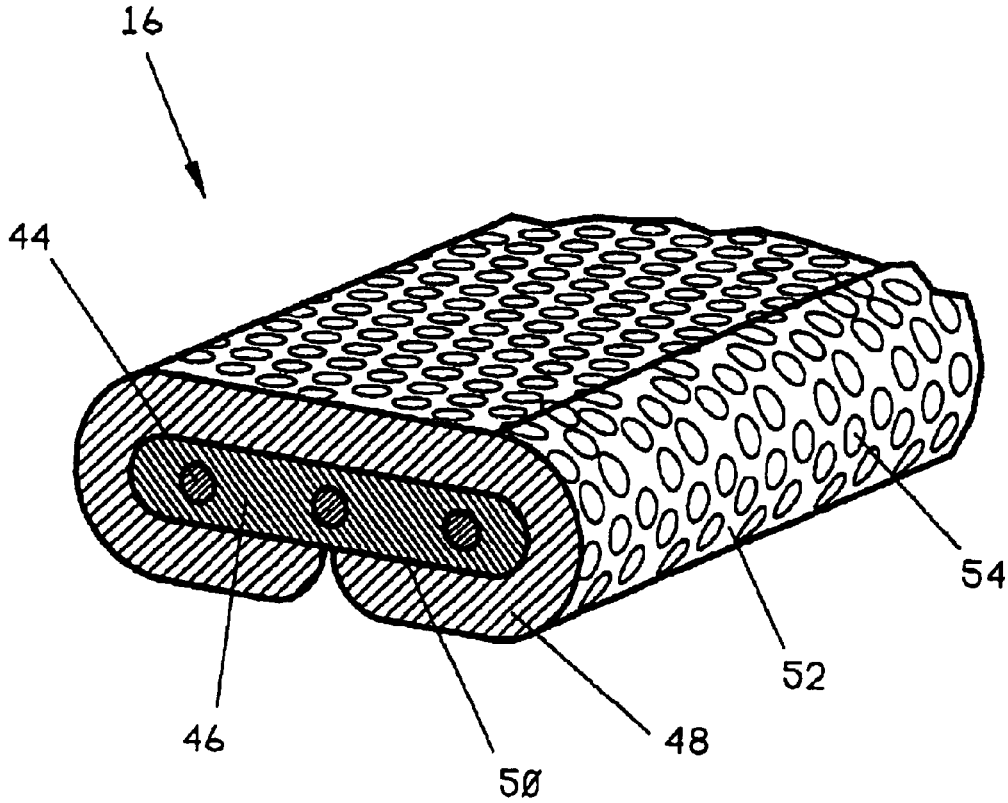

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–22, 24 and 25 is confirmed.

Claim 23 is cancelled.

New claims 26–53 are added and determined to be patentable.

*26. A lacing for a game ball, wherein the lacing is configured for direct contact with a user's hands, the lacing comprising:*

*an inner substrate and*

*an outer layer fixedly coupled to the inner substrate, the outer layer of the lacing having an exposed surface made of an outer polymeric material that is compressible, resilient and highly grip-able, the exposed surface providing a high level of frictional interaction with the hands of the user, the lacing further including at least one longitudinally extending segment and a plurality of transversely extending segments, the game ball configured for use in competitive play.*

*27. The lacing of claim 26, wherein the outer layer is a sheet.*

*28. The lacing of claim 27, wherein the sheet is a unitary flexible body.*

*29. The lacing of claim 27, wherein the thickness of the sheet between the exposed surface and an inner surface of the sheet is a generally uniform and continuous.*

*30. The lacing of claim 26, wherein the lacing has a generally oval transverse cross-sectional shape.*

*31. The lacing of claim 26, wherein the lacing has a generally circular transverse cross-sectional shape.*

*32. The lacing of claim 26, wherein the outer layer is a porous or spongy polymeric foam layer.*

*33. The lacing of claim 26, wherein the polymeric material is a polyurethane.*

*34. The lacing of claim 26, wherein the polymeric material is a wet-process polyurethane or a dry process polyurethane.*

*35. The lacing of claim 26, wherein the polymeric material is a polyvinylchloride.*

*36. The lacing of claim 26, wherein the inner substrate has a top side and a bottom side, and wherein the outer layer is extends over only the top side.*

*37. The lacing of claim 26, wherein the outer layer substantially surrounds the inner substrate.*

*38. The lacing of claim 26, wherein the inner substrate is formed from at least one material selected from the group consisting of a woven cloth, a non-woven cloth, a urethane impregnated cloth, and a combination thereof.*

*39. The lacing of claim 26, wherein the inner substrate is formed from at least one material selected from the group consisting of at least one nylon strand, at least one polyester strand, a plastic, a metal wire, a polymer, a latex, a rope, a leather strip, and a combination thereof.*

*40. A lacing for a football wherein the lacing includes an inner substrate fixedly coupled to an outer layer, the outer layer of the lacing having an exposed surface made of an outer polymeric material that is compressible, resilient, and highly grip-able when directly contacted by a user's hand, the lacing further including at least one longitudinally extending segment and a plurality of transversely extending segments, the football configured for use in competitive play.*

*41. The lacing of claim 40, wherein the outer layer is a sheet.*

*42. The lacing of claim 40, wherein the sheet is a unitary flexible body.*

*43. The lacing of claim 40, wherein the thickness of the sheet between the exposed surface and an inner surface of the sheet is generally uniform and continuous.*

*44. The lacing of claim 40, wherein the lacing has generally oval transverse cross-sectional shape.*

*45. The lacing of claim 40, wherein the lacing has a generally circular transverse cross-sectional shape.*

*46. The lacing of claim 40, wherein the outer layer is a porous or spongy polymeric foam layer.*

*47. The lacing of claim 40, wherein the polymeric material is a polyurethane.*

*48. The lacing of claim 40, wherein the polymeric material is a wet-process polyurethane or a dry process polyurethane.*

*49. The lacing of claim 40, wherein the polymeric material is a polyvinylchloride.*

*50. The lacing of claim 40, wherein the inner substrate has a top side and a bottom side, and wherein the outer layer is extends over only the top side.*

*51. The lacing of claim 40, wherein the outer layer substantially surrounds the inner substrate.*

*52. The lacing of claim 26, wherein the inner substrate is formed from at least one material selected from the group consisting of a woven cloth, a non-woven cloth, a urethane impregnated cloth, and a combination thereof.*

*53. The lacing of claim 26, wherein the inner substrate is formed from at least one material selected from the group consisting of at least one nylon strand, at least one polyester strand, a plastic, a metal wire, a polymer, a latex, a rope, a leather strip, and a combination thereof.*

* * * * *